US007554519B2

(12) United States Patent
Lin et al.

(10) Patent No.: US 7,554,519 B2
(45) Date of Patent: Jun. 30, 2009

(54) SYSTEM AND METHOD FOR AUTOMATICALLY ADJUSTING THE CLOCK PHASE OF A DISPLAY IN REAL-TIME

(75) Inventors: Walter C. Lin, Santa Clara, CA (US); Jiande Jiang, San Jose, CA (US)

(73) Assignee: Trident Microsystems (Far East) Ltd., Taipei (TW)

( * ) Notice: Subject to any disclaimer, the term of this patent is extended or adjusted under 35 U.S.C. 154(b) by 880 days.

(21) Appl. No.: 10/912,646

(22) Filed: Aug. 4, 2004

(65) Prior Publication Data

US 2006/0028460 A1 Feb. 9, 2006

(51) Int. Cl.
*G09G 3/36* (2006.01)

(52) U.S. Cl. ..... 345/99; 345/87

(58) Field of Classification Search ..... 345/87–104
See application file for complete search history.

(56) References Cited

U.S. PATENT DOCUMENTS 6,285,344 B1 9/2001 Everard et al.

FOREIGN PATENT DOCUMENTS

JP 2000338924 12/2000

OTHER PUBLICATIONS

First Office Action issued Aug. 17, 2007 by the Patent Office of the People's Republic of China re corresponding Chinese Patent Application No. 200510098070.6, including English-language translation thereof.

*Primary Examiner*—Richard Hjerpe
*Assistant Examiner*—Srilakshmi K Kumar
(74) *Attorney, Agent, or Firm*—DLA Piper LLP (US)

(57) ABSTRACT

The present invention provides a system and method for adjusting clock phase in a digital display. The display 10 may include a target analog-to-digital converter 104 that generates a first digital signal based on an analog input signal and a first clock signal (CLK1). The system 100 includes a first clock phase adjustment circuit 108, which provides CLK1 to the target analog-to-digital converter 104. A second analog-to-digital converter 106 receives at least a portion of the analog input signal and a second adjusted clock signal (CLK2), and generates a second digital signal based on these inputs. A second clock phase adjustment circuit 100 is communicatively coupled to the second analog-to-digital converter 106, and transmits CLK2 to the second analog-to-digital converter. A controller 112 receives the second digital signal from the second analog-to-digital converter 106 and uses the signal to determine a preferred phase of CLK2. The controller 112 then causes the first clock phase adjustment circuit to adjust the phase of CLK1 based on the preferred phase.

18 Claims, 2 Drawing Sheets

SYSTEM AND METHOD FOR AUTOMATICALLY ADJUSTING THE CLOCK PHASE OF A DISPLAY IN REAL-TIME

FIELD OF THE INVENTION

The present invention generally relates to digital display devices, and more particularly to a system and method for automatically adjusting the clock phase of a digital display device in real-time.

BACKGROUND OF THE INVENTION

Conventional digital display devices, such as liquid crystal display (LCD) monitors, receive analog signals from a video source (e.g., a personal computer) and convert the analog signals into a digital image. This conversion process involves various image processing steps including an analog to digital conversion. The analog-to-digital conversion is typically performed by an A/D converting device (e.g., an A/D converter). The A/D converter receives a system clock signal that controls the operation of the converter. Particularly, the pulses of the clock signal are used to sample the rising and/or falling edges of the analog input signal. The conversion process requires the sampling frequency and phase to be precisely synchronized with the analog video signals. Otherwise, the display image can be degraded overall, can include areas that are blurred, or can be misaligned to the display area of the display monitor. Over time, the analog input signal may vary with the phase of the clock signal due to environmental and other effects. As a result, the sampling may occur at improper intervals, thereby resulting in a blurry or noisy image.

Conventional display devices typically include a clock phase adjusting circuit, which detects the best clock phase at a given point in time, and outputs the best clock phase to the A/D converter, thereby correcting the displayed image. The clock phase adjusting circuit is typically activated by a user interface or control. The user interface or control may include a button or switch located in the housing of the display device. Alternatively, other manually-controlled user interfaces and input devices may be available. All of these prior systems suffer from drawbacks that are undesirable to users of the display devices.

For example, these prior art display devices require a user to monitor the displayed image for faults and operate the controls to perform the adjustment manually. This is inconvenient for the user. Furthermore, by the time the clock phase error becomes visibly apparent to a user, the clock is significantly out of phase, and the resulting clock phase correction will visibly and adversely affect the quality of the displayed image.

Therefore, it would be desirable to provide a system and method for adjusting the clock phase of a digital display which automatically adjusts clock phase in real-time and in a manner invisible to a user of the display.

SUMMARY OF THE INVENTION

The present invention provides a system and method for automatically adjusting the clock phase in a digital display device. The system adjusts the clock phase periodically in a manner that is invisible to the user and requires no user interaction.

According to one aspect of the present invention, a system is provided for adjusting clock phase in a digital display including a first analog-to-digital converter that generates a first digital signal based on an analog input signal and a first clock signal. The system includes a first clock phase adjustment circuit, which is communicatively coupled to the first analog-to-digital converter, and which provides the first clock signal to the first analog-to-digital converter. A second analog-to-digital converter receives at least a portion of the analog input signal and a second adjusted clock signal, and generates a second digital signal based on the input signal and the second adjusted clock signal. A second clock phase adjustment circuit is communicatively coupled to the second analog-to-digital converter, and transmits the second adjusted clock signal to the second analog-to-digital converter. A controller is communicatively coupled to the second analog-to-digital converter and to the first and second clock phase adjustment circuits. The controller is adapted to determine a selected phase of the second adjusted clock signal using the second clock phase adjustment circuit and the second digital signal, and to cause the first clock phase adjustment circuit to adjust the phase of the first clock signal based on the selected phase.

According to another aspect of the present invention, a system is provided for converting an analog video signal into a digital video signal for display on a digital display device. The system includes a first circuit that converts the analog video signal into the digital video signal according to a first sampling clock signal; and a second circuit that is communicatively coupled to the first circuit, that identifies a preferred phase using a second sampling clock signal and at least a portion of the analog video signal, and that causes the first circuit to update a phase of the first sampling clock signal based on the preferred phase.

According to another aspect of the present invention, a display device is provided. The display device includes a display monitor for displaying an image provided by a video source; and an A/D conversion circuit that is communicatively coupled to the display monitor, the A/D conversion circuit including a first A/D converter that uses a first clock signal to convert an analog input signal from the video source into a first digital signal that is used by the display monitor for displaying an image, and a clock phase adjustment system for adjusting a phase of the first clock signal. The clock phase adjustment system includes a first clock phase adjustment circuit, which is communicatively coupled to the first A/D converter, and which provides the first clock signal to the first A/D converter; a second A/D converter that receives at least a portion of the analog input signal and that converts the received signal into a second digital signal; a second clock phase adjustment circuit, which is communicatively coupled to the second A/D converter, and which provides a second clock signal to the second A/D converter; and a controller, which is communicatively coupled to the second A/D converter and to the first and second clock phase adjustment circuits, the controller being adapted to determine a preferred phase of the second clock signal using the second clock phase adjustment circuit and the second digital signal, and to cause the first clock phase adjustment circuit to adjust the phase of the first clock signal based on the preferred phase.

According to another aspect of the present invention, a method is provided for adjusting a phase of a first clock signal that controls an analog-to-digital conversion process in a digital display device. The method includes providing a second clock signal; determining a preferred phase using the second clock signal and at least a portion of the analog input signal; and adjusting the phase of the first clock signal based on the preferred phase.

These and other features and advantages of the invention will become apparent by reference to the following specification and by reference to the following drawings.

DETAILED DESCRIPTION OF THE EMBODIMENTS

The present invention will now be described in detail with reference to the drawings, which are provided as illustrative examples of the invention so as to enable those skilled in the art to practice the invention. Notably, the implementation of certain elements of the present invention may be accomplished using software, hardware, firmware or any combination thereof, as would be apparent to those of ordinary skill in the art, and the figures and examples below are not meant to limit the scope of the present invention. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Preferred embodiments of the present invention are illustrated in the Figures, like numerals being used to refer to like and corresponding parts of various drawings.

Figure 1:
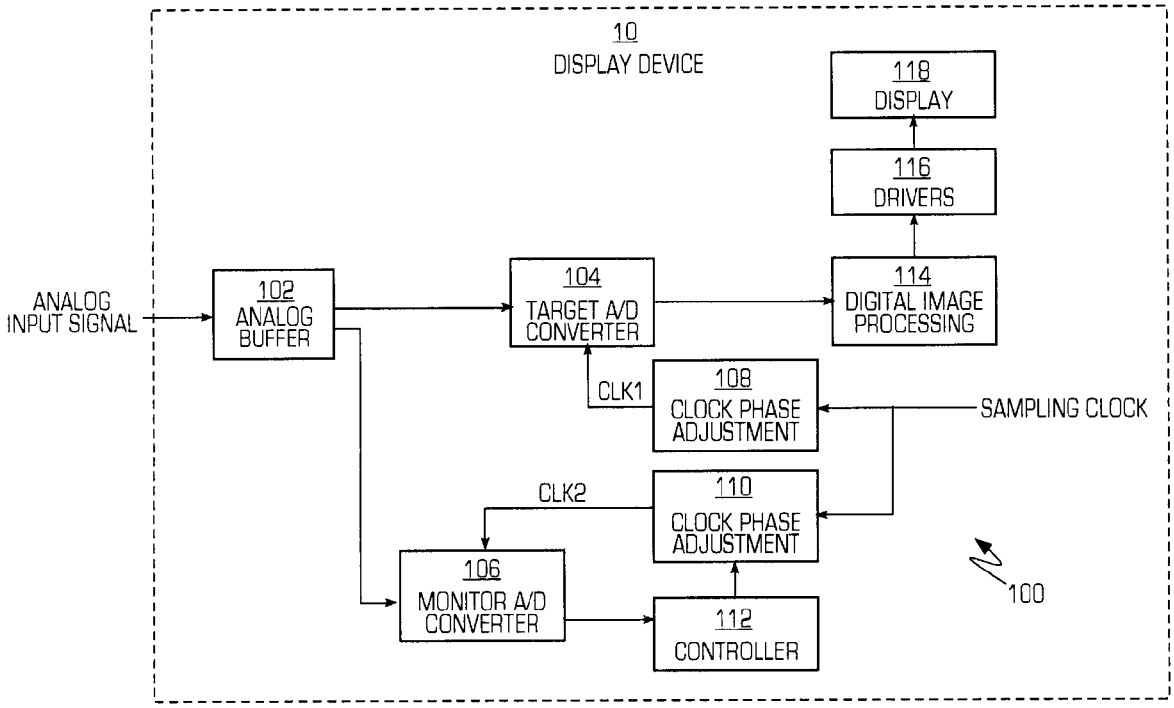
FIG. 1 illustrates a block diagram of a display device including a system for automatically adjusting the clock phase of the digital display device, in accordance with the present invention.

FIG. 1 illustrates a block diagram of a digital display device 10 including a system 100 for automatically adjusting the clock phase of the display, according to one embodiment of the present invention. For purposes of clarity, only those components of the display 10 that are relevant to the present invention are illustrated and discussed. Furthermore, while the present invention will be primarily described in relation to a system 100, it should be appreciated that each of the portions or blocks illustrated in FIG. 1 may represent logic steps or processes performed in according to an inventive method. Conventional hardware, software and/or firmware may be used to perform the logic steps and/or processes.

System 100 includes an analog buffer chip 102, a target analog to digital (A/D) converter 104, a monitor A/D converter 106, clock phase adjustment circuits 108, 110, and a controller 112. System 100 may form a portion of a receiver of the digital display device 10 (e.g., an LCD or plasma monitor) for converting analog video signals into digital samples. The display device 10 may include conventional image processing circuitry 114, display drivers 116 and a display screen or monitor 118. Circuitry 114 may be conventional image processing circuitry that is adapted to process image data from system 100, and to provide the processed data to drivers 116. Drivers 116 may include a conventional driving circuit, which drives the electronics in display screen 118, thereby causing the display monitor 118 to display the digital image. The display device 10 may further include a conventional frame buffer and a controller for providing the samples from the buffer to the drivers 116 and monitor 118.

Analog buffer chip 102 is a conventional analog buffer circuit, which is adapted to drive analog image signals to an A/D converter. A source, such as a host computer system or video terminal (not shown), generates the analog signals synchronously and provides the signals to the analog buffer 102. In the preferred embodiment, the image signal comprises a three-channel video signal. The three channels may respectively correspond to conventional analog video signal channels, such as R (red), G (green), and B (blue) channels; Y (luminance), U (saturation) and V (value) channels; or the like. In alternate embodiments, the analog input signal may comprise any other type of single or multi-channel analog video signal.

Analog buffer 102 is communicatively coupled to target A/D converter 104 and to monitor A/D converter 106. In one embodiment, buffer 102 communicates all channels of the input signal to target A/D converter 104, and a single channel of the input signal to monitor A/D converter 106. Target A/D converter 104 is communicatively coupled to clock phase adjustment circuit 108 and image processing circuitry 114. Target A/D converter 104 is a conventional A/D converter, which is adapted to convert the three channel analog input signal into a three channel digital image signal, which is communicated to the image processing circuitry 114. The target A/D converter 104 provides the digital image signal by sampling each of the three channels in accordance with the clock signal. Monitor A/D converter 106 is communicatively coupled to clock phase adjustment circuit 110 and controller 112. Monitor A/D converter 106 is a conventional A/D converter, which is adapted to convert the received analog input signal into a digital signal that is communicated to the controller 112. In the one embodiment, the monitor A/D converter 106 is a single-channel converter, adapted to receive and sample a single channel of the analog input signal, which allows for a simplified A/D converter and controller 112, as explained below.

Clock phase adjustment circuits 108 and 110 receive a clock signal CLK (e.g. from a sampling clock) and are communicatively coupled to control and processing circuit 112. Clock phase adjustment circuits 108, 110 are adapted to receive the clock signal CLK and to selectively adjust the phase of the signal, based on input signals received from controller 112. The resulting adjusted clock signal from circuits 108, 110 (i.e., CLK1 and CLK2) are provided to target A/D converter 104 and monitor A/D converter 106, respectively. Each of the clock phase adjustment circuits 108, 110 is preferably capable of altering the phase of the clock signal CLK in relatively small increments. In one embodiment, the clock cycle is divided into 32 separate phases and the circuits 108, 110 may select from any of the 32 phases, depending on the value of the input signal provided by the controller 112.

In one embodiment, controller 112 is a conventional microcontroller including a microprocessor and tuning circuitry. The controller 112 may comprise a single integrated chip or several disparate chips communicatively coupled together. The tuning circuitry and processor operate together to control the phase applied to the clock signal CLK by clock phase adjustment circuits 108, 110. As explained more fully and completely below, the controller 112 receives information from the monitor A/D converter 106 and uses the information to control circuits 108, 110 to provide an improved image displayed by monitor 118. Accordingly, the target sampling clock signal CLK1 is optimized to correspond to the analog video signals provided by the analog buffer 102.

In operation, the system 100 automatically and continuously monitors and compensates for variances between the phase of the analog input signal and the phase of the system clock to ensure that sampling is occurring in an appropriate manner. Such variances may occur due to changes in temperature, source timing, cable variances, power variances, environmental factors, and the like. The analog buffer 102 receives the analog signal from the video source (e.g., a computer) and provides all channels of the multi-channel (e.g., three-channel) to the target A/D converter 104. The target A/D 104 converter samples all three channels according to the clock signal received from the clock phase adjustment circuit 108. The resulting output is a multi-channel (e.g., three-channel) digital input signal, which is communicated to the image processing circuitry 114. For sampling each of the three RGB signals, the target A/D converter 104 may include three channels. Alternatively, the A/D converter 104 may comprise three single-channel A/D converters. In one embodiment, the digital samples formed by the A/D converter 104 are 8-bit samples, thus, providing 256 discrete sample values, although another number of bits may be selected for the samples. The image processing circuitry 114 processes the signal and provides the processed output to drivers 116, which drive the pixels of the display screen 118, thereby producing an image.

The analog buffer 102 also communicates at least one of the channels of the input signal to monitor A/D converter 106. In one embodiment, analog buffer 102 communicates only a single channel of the input signal to the monitor A/D converter 106. This allows for a simplified single-channel A/D converter to be used for A/D converter 106, and a simplified controller and tuning circuit. The use of a single channel will not have an adverse affect on operation, since all three channels are typically share the same phase and variations that occur will typically affect channels equally. The monitor A/D converter 106 samples the analog signal based on the clock phase signal provided by clock phase adjustment circuit 110. The resulting digital output is provided to the controller 112, which uses the signal to continuously monitor and periodically adjust the phase alignment of the analog input signal and the clock signal.

The controller 112 may monitor this alignment by searching for sampled values that represent a sharp border or transition between a light and dark area in the display image. In these "transition areas", samples of the analog signal that are proximate in time have significantly different values.

Figure 2:
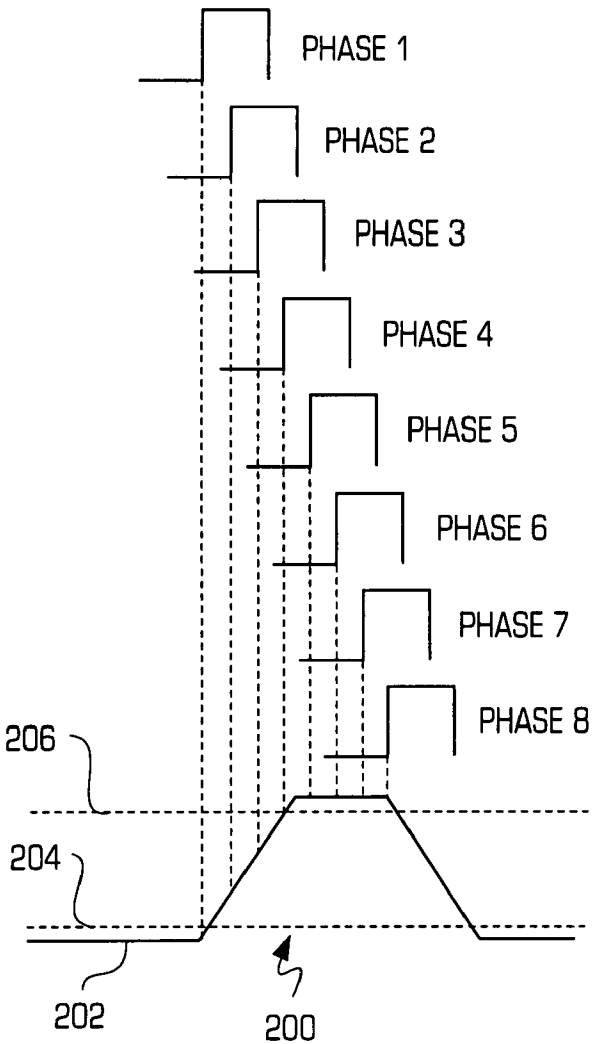
FIG. 2 illustrates an example of a timing diagram for adjusting the phase of a sampling clock signal.

FIG. 2 illustrates a transition 200 in an analog video signal 202 that would appear in a display image as a transition between a dark and light area. Once controller 112 identifies such a transition, it signals circuit 110 to adjust the phase of the clock signal to each of a plurality of phases (e.g., phases 1-8). Although FIG. 2 illustrates a simplified example with only 8 phases, any number of phases may be sampled according to the invention. Upon a leading edge of the clock signal for each of the plurality of phases a sample is taken of the waveform 202, as shown in FIG. 2 by the vertical dotted lines that intersect the waveform 202.

Whether a phase of the clock signal is appropriate may be determined by comparing the corresponding samples to various threshold levels 204, 206. More particularly, assuming that a phase results in sampling the waveform 202 below the level 204, then this indicates that the lower level is being sampled (e.g., phase 1). Assuming that a phase results in sampling the waveform 202 above the level 206, then this indicates that the phase results in sampling at the higher level (e.g., phases 5-8). Alternately, differences between samples, such as between the lowest and highest level samples, can be utilized to determine whether a particular sampling phase is appropriate.

In general, a sampling phase is considered appropriate if it results in sampling the analog video signal in a stable, non-transitional, region. Phase 1 results in sampling the analog video signal 202 in a stable region for the lower value of the signal 202. Similarly, phases 5-8 result in sampling the analog video signal 202 in a stable region for the higher value of the signal 202. In contrast, phases 2-4 result in sampling the video signal 202 in an unstable or transitional region of the signal 202.

The controller 112 selects a preferred one of the phases based on the foregoing analysis. While any of the Phases 1, 5-8 would be suitable, an optimal phase may be selected that is between other suitable phases. This is so that if the phase drifts slightly or if ringing or noise occurs, the selected phase will still result in appropriate sampling of the analog RGB video signals. More particularly, phase 6 is between phase 5 and phase 7, while phase 7 is between phase 6 and phase 8, all of which result in sampling in a stable region of the video signal 202. Thus, phase 6 or phase 7 may be preferably selected for the clock signal.

Once controller 112 selects an appropriate phase, it instructs the clock phase adjustment block 110 to adopt the selected phase. The selected phase is also communicated to the target clock phase adjustment block 108 and used at the target A/D converter 104. In one embodiment, a delta value may be added (or subtracted) from the selected phase prior to communicating the phase to target clock phase adjustment block 108. For example, the phase of CLK1 may equal the phase CLK2+/−Δ. The delta term may be calculated or determined in a conventional manner based on the physical attributes of the circuit in order to compensate for a deviation between the target A/D converter 104 and the monitor A/D converter 106.

In the foregoing manner, the second or monitor clock signal (CLK2) is utilized for a "trial and error" process while the first or target clock signal (CLK1) is utilized only for sampling the analog video signals for generation of a display image. Accordingly, the first clock signal (CLK1) and, thus, the display image, are not affected during performance of the "trial and error" process. Once an appropriate phase for the sampling clock is determined (by use of the second clock signal), only then is the phase of the sampling clock (the first clock signal) adjusted to affect the display image.

This is in contrast to prior art systems, where only a single clock phase adjustment circuit is used. Inevitably, in these prior art systems the sampling phase in transition areas (e.g., phases 2-4 in the FIG. 2 example) is used to sample the analog video signals for the entire display image. As mentioned in the example, certain phases (e.g., phases 2-4) result in sampling the video signal 202 at an inappropriate time, such as during an unstable, transition period. This undesirably causes distortion in the display and is used sparingly, such as in response to a re-calibration command from a user or upon start-up of a computer system.

The foregoing invention may also be adapted to automatically adjust the phase of the clock signal at predetermined time intervals (e.g., once every few seconds). The continuous monitoring by the CPU 112 allows the clock phase to be adjusted in real-time before the displayed images are visibly distorted to the user. The automatic adjustment provided by the present invention is also very desirable, as it does not require any user interaction. Therefore, a user of a display implementing the present invention can continue to work and use the display without viewing any distortion while the clock signal is maintained at an optimal phase.

From the foregoing, it should be apparent that the present invention provides an improved system and method for adjusting the clock phase of a digital display device and a digital display device incorporating the system and method.

While the foregoing has been with reference to particular embodiments of the invention, it will be appreciated by those skilled in the art that changes in these embodiments may be made without departing from the principles and spirit of the invention, the scope of which is defined by the appended claims.

What is claimed is:

1. A system-for adjusting clock phase in a digital display including a first analog-to-digital converter that generates a first digital signal based on an analog input signal and a first clock signal, the system comprising:

a first clock phase adjustment circuit, which is communicatively coupled to the first analog-to-digital converter, and which provides the first clock signal to the first analog-to-digital converter;

a second analog-to-digital converter that receives at least a portion of the analog input signal and a second adjusted clock signal, and that generates a second digital signal based on the input signal and the second adjusted clock signal;

a second clock phase adjustment circuit, which is communicatively coupled to the second analog-to-digital converter, and which provides the second adjusted clock signal to the second analog-to-digital converter; and a controller, which is communicatively coupled to the second analog-to-digital converter and to the first and second clock phase adjustment circuits, the controller being adapted to determine a selected phase of the second adjusted clock signal using the second clock phase adjustment circuit and the second digital signal, and to cause the first clock phase adjustment circuit to adjust the phase of the first clock signal based on the selected phase;

wherein the analog input signal comprises a plurality of channels and the second analog to digital converter receives a single channel of the analog input signal.

2. A system for adjusting clock phase in a digital display including a first analog-to-digital converter that generates a first digital signal based on an analog input signal and a first clock signal, the system comprising:

a first clock phase adjustment circuit, which is communicatively coupled to the first analog-to-digital converter, and which provides the first clock signal to the first analog-to-digital converter;

a second analog-to-digital converter that receives at least a portion of the analog input signal and a second adjusted clock signal, and that generates a second digital signal based on the input signal and the second adjusted clock signal;

a second clock phase adjustment circuit, which is communicatively coupled to the second analog-to-digital converter, and which provides the second adjusted clock signal to the second analog-to-digital converter; and a controller, which is communicatively coupled to the second analog-to-digital converter and to the first and second clock phase adjustment circuits, the controller being adapted to determine a selected phase of the second adjusted clock signal using the second clock phase adjustment circuit and the second digital signal, and to cause the first clock phase adjustment circuit to adjust the phase of the first clock signal based on the selected phase;

wherein the first and second clock phase adjustment circuits are adapted to select between a plurality of phases and to adjust the phase of the clock signal to a selected phase according to a signal generated by the controller.

3. The system of claim 2 wherein the first and second clock phase adjustment circuits are adapted to select between 32 different clock phases.

4. A system for adjusting clock phase in a digital display including a first analog-to-digital converter that generates a first digital signal based on an analog input signal and a first clock signal, the system comprising:

a first clock phase adjustment circuit, which is communicatively coupled to the first analog-to-digital converter, and which provides the first clock signal to the first analog-to-digital converter;

a second analog-to-digital converter that receives at least a portion of the analog input signal and a second adjusted clock signal, and that generates a second digital signal based on the input signal and the second adjusted clock signal;

a second clock phase adjustment circuit, which is communicatively coupled to the second analog-to-digital converter, and which provides the second adjusted clock signal to the second analog-to-digital converter; and a controller, which is communicatively coupled to the second analog-to-digital converter and to the first and second clock phase adjustment circuits, the controller being adapted to determine a selected phase of the second adjusted clock signal using the second clock phase adjustment circuit and the second digital signal, and to cause the first clock phase adjustment circuit to adjust the phase of the first clock signal based on the selected phase;

wherein the controller is adapted to determine a selected phase by identifying samples that represent a stable portion of the analog input signal.

5. A system for adjusting clock phase in a digital display including a first analog-to-digital converter that generates a first digital signal based on an analog input signal and a first clock signal, the system comprising:

a first clock phase adjustment circuit, which is communicatively coupled to the first analog-to-digital converter, and which provides the first clock signal to the first analog-to-digital converter;

a second analog-to-digital converter that receives at least a portion of the analog input signal and a second adjusted clock signal, and that generates a second digital signal based on the input signal and the second adjusted clock signal;

a second clock phase adjustment circuit, which is communicatively coupled to the second analog-to-digital converter, and which provides the second adjusted clock signal to the second analog-to-digital converter; and a controller, which is communicatively coupled to the second analog-to-digital converter and to the first and second clock phase adjustment circuits, the controller being adapted to determine a selected phase of the second adjusted clock signal using the second clock phase adjustment circuit and the second digital signal, and to cause the first clock phase adjustment circuit to adjust the phase of the first clock signal based on the selected phase;

wherein the controller causes the phase of the first clock signal to be equal to the selected phase.

6. A system for adjusting clock phase in a digital display including a first analog-to-digital converter that generates a first digital signal based on an analog input signal and a first clock signal, the system comprising:

a first clock phase adjustment circuit, which is communicatively coupled to the first analog-to-digital converter, and which provides the first clock signal to the first analog-to-digital converter;

a second analog-to-digital converter that receives at least a portion of the analog input signal and a second adjusted clock signal, and that generates a second digital signal based on the input signal and the second adjusted clock signal;

a second clock phase adjustment circuit, which is communicatively coupled to the second analog-to-digital converter, and which provides the second adjusted clock signal to the second analog-to-digital converter; and a controller, which is communicatively coupled to the second analog-to-digital converter and to the first and second clock phase adjustment circuits, the controller being adapted to determine a selected phase of the second adjusted clock signal using the second clock phase adjustment circuit and the second digital signal, and to cause the first clock phase adjustment circuit to adjust the phase of the first clock signal based on the selected phase;

wherein the controller causes the phase of the first clock signal to be equal to the selected phase plus or minus a delta value.

7. A system for adjusting clock phase in a digital display including a first analog-to-digital converter that generates a first digital signal based on an analog input signal and a first clock signal, the system comprising:

a first clock phase adjustment circuit, which is communicatively coupled to the first analog-to-digital converter, and which provides the first clock signal to the first analog-to-digital converter;

a second analog-to-digital converter that receives at least a portion of the analog input signal and a second adjusted clock signal, and that generates a second digital signal based on the input signal and the second adjusted clock signal;

a second clock phase adjustment circuit, which is communicatively coupled to the second analog-to-digital converter, and which provides the second adjusted clock signal to the second analog-to-digital converter; and a controller, which is communicatively coupled to the second analog-to-digital converter and to the first and second clock phase adjustment circuits, the controller being adapted to determine a selected phase of the second adjusted clock signal using the second clock phase adjustment circuit and the second digital signal, and to cause the first clock phase adjustment circuit to adjust the phase of the first clock signal based on the selected phase;

wherein the controller is adapted to automatically determine a selected phase of the second adjusted clock signal at predetermined time intervals.

8. A system for converting an analog video signal into a digital video signal for display on a digital display device, the system comprising:

a first circuit that converts the analog video signal into the digital video signal according to a first sampling clock signal; and a second circuit that is communicatively coupled to the first circuit, that identifies a preferred phase using a second sampling clock signal and at least a portion of the analog video signal, and that causes the first circuit to update a phase of the first sampling clock signal based on the preferred phase;

wherein the first circuit comprises a first A/D converter that receives the analog video signal and samples the analog video signal according to the first sampling clock signal to generate the digital video signal, the second circuit comprises a clock phase adjustment circuit that selectively alters a phase of the second sampling clock signal;

a second A/D converter that converts at least a portion of the analog video signal to a second digital signal according to the second sampling clock signal; and a controller that causes the clock phase adjustment circuit to selectively alter the phase of the second sampling clock signal and that monitors the second digital signal to select a preferred phase; and the controller causes the clock phase adjustment circuit to selectively alter the phase of the second sampling clock signal at predetermined time intervals.

9. A system for converting an analog video signal into a digital video signal for display on a digital display device, the system comprising:

a first circuit that converts the analog video signal into the digital video signal according to a first sampling clock signal; and a second circuit that is communicatively coupled to the first circuit, that identifies a preferred phase using a second sampling clock signal and at least a portion of the analog video signal, and that causes the first circuit to update a phase of the first sampling clock signal based on the preferred phase;

wherein the first circuit comprises a first A/D converter that receives the analog video signal and samples the analog video signal according to the first sampling clock signal to generate the digital video signal;

the second circuit comprises a clock phase adjustment circuit that selectively alters a phase of the second sampling clock signal; a second A/D converter that converts at least a portion of the analog video signal to a second digital signal according to the second sampling clock signal;

a controller that causes the clock phase adjustment circuit to selectively alter the phase of the second sampling clock signal and that monitors the second digital signal to select a preferred phase; and the second A/D converter is adapted to convert a single channel of the analog video signal to a second digital signal.

10. A system for converting an analog video signal into a digital video signal for display on a digital display device, the system comprising:

a first circuit that converts the analog video signal into the digital video signal according to a first sampling clock signal; and a second circuit that is communicatively coupled to the first circuit, that identifies a preferred phase using a second sampling clock signal and at least a portion of the analog video signal, and that causes the first circuit to update a phase of the first sampling clock signal based on the preferred phase;

wherein the second circuit causes the phase of the first sampling clock signal to be equal to the preferred phase.

11. A system for converting an analog video signal into a digital video signal for display on a digital display device, the system comprising:

a first circuit that converts the analog video signal into the digital video signal according to a first sampling clock signal; and a second circuit that is communicatively coupled to the first circuit, that identifies a preferred phase using a second sampling clock signal and at least a portion of the analog video signal, and that causes the first circuit to update a phase of the first sampling clock signal based on the preferred phase;

wherein the second circuit causes the phase of the first sampling clock signal to be equal to the preferred phase plus or minus a delta value.

12. A display device comprising:

a display monitor for displaying of an image provided to the display monitor by a video source; and an A/D conversion circuit that is communicatively coupled to the display monitor, the A/D conversion circuit including a first A/D converter that uses a first clock signal to convert an analog input signal from the video source into a first digital signal that is used by the display monitor to display an image, and a clock phase adjustment system for adjusting a phase of the first clock signal, the clock phase adjustment system comprising:

a first clock phase adjustment circuit, which is communicatively coupled to the first A/D converter, and which provides the first clock signal to the first A/D converter;

a second A/D converter that receives at least a portion of the analog input signal and that converts the received signal into a second digital signal;

a second clock phase adjustment circuit, which is communicatively coupled to the second A/D converter, and which provides a second clock signal to the second A/D converter; and a controller, which is communicatively coupled to the second A/D converter and to the first and second clock phase adjustment circuits, the controller being adapted to determine a preferred phase of the second clock signal using the second clock phase adjustment circuit and the second digital signal, and to cause the first clock phase adjustment circuit to adjust the phase of the first clock signal based on the preferred phase;

wherein the analog input signal comprises multi-channel signal and the second A/D converter receives a single channel of the analog input signal.

13. A display device comprising:

a display monitor for displaying of an image provided to the display monitor by a video source; and an A/D conversion circuit that is communicatively coupled to the display monitor, the A/D conversion circuit including a first A/D converter that uses a first clock signal to convert an analog input signal from the video source into a first digital signal that is used by the display monitor to display an image, and a clock phase adjustment system for adjusting a phase of the first clock signal, the clock phase adjustment system comprising:

a first clock phase adjustment circuit, which is communicatively coupled to the first A/D converter, and which provides the first clock signal to the first A/D converter;

a second A/D converter that receives at least a portion of the analog input signal and that converts the received signal into a second digital signal;

a second clock phase adjustment circuit, which is communicatively coupled to the second A/D converter, and which provides a second clock signal to the second A/D converter; and a controller, which is communicatively coupled to the second A/D converter and to the first and second clock phase adjustment circuits, the controller being adapted to determine as a function of only one clock signal input, a preferred phase of the second clock signal using the second clock phase adjustment circuit and the second digital signal, and to cause the first clock phase adjustment circuit to adjust the phase of the first clock signal based on the preferred phase wherein the analog input signal comprises multi-channel signal and the second A/D converter is adapted to convert a single channel of the analog input signal to a second digital signal.

14. A display device comprising:

a display monitor for displaying of an image provided to the display monitor by a video source; and an A/D conversion circuit that is communicatively coupled to the display monitor, the A/D conversion circuit including a first A/D converter that uses a first clock signal to convert an analog input signal from the video source into a first digital signal that is used by the display monitor to display an image, and a clock phase adjustment system for adjusting a phase of the first clock signal, the clock phase adjustment system comprising:

a first clock phase adjustment circuit, which is communicatively coupled to the first A/D converter, and which provides the first clock signal to the first A/D converter;

a second A/D converter that receives at least a portion of the analog input signal and that converts the received signal into a second digital signal;

a second clock phase adjustment circuit, which is communicatively coupled to the second A/D converter, and which provides a second clock signal to the second A/D converter; and a controller, which is communicatively coupled to the second A/D converter and to the first and second clock phase adjustment circuits, the controller being adapted to determine a preferred phase of the second clock signal using the second clock phase adjustment circuit and the second digital signal, and to cause the first clock phase adjustment circuit to adjust the phase of the first clock signal based on the preferred phase, wherein the controller causes the phase of the first clock signal to be equal to the preferred phase.

15. A display device comprising:

a display monitor for displaying of an image provided to the display monitor by a video source; and an A/D conversion circuit that is communicatively coupled to the display monitor, the A/D conversion circuit including a first A/D converter that uses a first clock signal to convert an analog input signal from the video source into a first digital signal that is used by the display monitor to display an image, and a clock phase adjustment system for adjusting a phase of the first clock signal, the clock phase adjustment system comprising:

a first clock phase adjustment circuit, which is communicatively coupled to the first A/D converter, and which provides the first clock signal to the first A/D converter;

a second A/D converter that receives at least a portion of the analog input signal and that converts the received signal into a second digital signal;

a second clock phase adjustment circuit, which is communicatively coupled to the second A/D converter, and which provides a second clock signal to the second A/D converter; and a controller, which is communicatively coupled to the second A/D converter and to the first and second clock phase adjustment circuits, the controller being adapted to determine a preferred phase of the second clock signal using the second clock phase adjustment circuit and the second digital signal, and to cause the first clock phase adjustment circuit to adjust the phase of the first clock signal based on the preferred phase, wherein the controller causes the phase of the first clock signal to be equal to the preferred phase plus or minus a delta value.

16. A method of adjusting a phase of a first clock signal that controls analog-to-digital conversion in a digital display process, the method comprising:

providing a second clock signal;

determining a preferred phase using the second clock signal and at least a portion of an analog input signal; and adjusting the phase of the first clock signal based on the preferred phase, wherein the phase of the first clock signal is adjusted to be equal to the preferred phase.

17. A method of adjusting a phase of a first clock signal that controls analog-to-digital conversion in a digital display process, the method comprising:

providing a second clock signal;

determining a preferred phase using the second clock signal and at least a portion of an analog input signal; and adjusting the phase of the first clock signal based on the preferred phase, wherein the phase of the first clock signal is adjusted to be equal to the preferred phase plus or minus a delta value.

18. A method of adjusting a phase of a first clock signal that controls analog-to-digital conversion in a digital display process, the method comprising:

providing a second clock signal;

determining a preferred phase using the second clock signal and at least a portion of an analog input signal; and adjusting the phase of the first clock signal based on the preferred phase;

wherein the analog input signal comprises at least three channels, and wherein a single channel of the analog input signal is used to determine the provided to the second analog to digital converter.

* * * * *